US011300334B2

(12) United States Patent
Schäfer et al.

(10) Patent No.: US 11,300,334 B2
(45) Date of Patent: Apr. 12, 2022

(54) DEVICE AND METHOD FOR INCREASING THE THERMAL OUTPUT OF A HEAT SOURCE

(71) Applicant: Siemens Aktiengesellschaft, Munich (DE)

(72) Inventors: Jochen Schäfer, Nuremberg (DE); Florian Reissner, Nuremberg (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 122 days.

(21) Appl. No.: 16/610,993

(22) PCT Filed: Apr. 30, 2018

(86) PCT No.: PCT/EP2018/061002
§ 371 (c)(1),
(2) Date: Nov. 5, 2019

(87) PCT Pub. No.: WO2018/206335
PCT Pub. Date: Nov. 15, 2018

(65) Prior Publication Data

US 2020/0173699 A1 Jun. 4, 2020

(30) Foreign Application Priority Data

May 12, 2017 (DE) ..... 10 2017 208 078.7

(51) Int. Cl.
*F25B 27/02* (2006.01)
*F25B 30/00* (2006.01)
(Continued)

(52) U.S. Cl.
CPC ..... *F25B 27/02* (2013.01); *F25B 30/00* (2013.01); *F25B 30/02* (2013.01); *F25B 30/06* (2013.01); *F25B 41/00* (2013.01); *F25B 41/40* (2021.01)

(58) Field of Classification Search
CPC ..... F25B 27/02; F25B 30/00; F25B 30/06; F25B 41/00; F25B 2313/002; F24D 11/0207; F24D 2200/11; F24D 2200/13
See application file for complete search history.

(56) References Cited

U.S. PATENT DOCUMENTS 10,662,583 B2 5/2020 Reissner et al.
2012/0103591 A1 5/2012 Tozer ..... 165/281
(Continued)

FOREIGN PATENT DOCUMENTS

CN 202581508 U 12/2012 ..... F24D 12/02
CN 104848597 A 8/2015 ..... F25B 25/00
(Continued)

OTHER PUBLICATIONS

Japanese Office Action, Application No. 2019562318, 9 pages, dated Feb. 2, 2021.
(Continued)

*Primary Examiner* — Elizabeth J Martin
(74) *Attorney, Agent, or Firm* — Slayden Grubert Beard PLLC

(57) ABSTRACT

Various examples include a device for increasing the heat yield of a heat source comprising: a heat sink; a heat pump with a condenser and an evaporator; and the heat source. The heat sink includes a heat sink feed and a heat sink return providing thermal coupling to the heat source with a heat exchanger. The heat source includes a heat source feed and a heat source return for thermal coupling to the heat sink with the heat exchanger. The condenser of the heat pump is thermally coupled to the heat sink feed to dissipate heat to the heat sink. The evaporator of the heat pump is thermally coupled to the heat source return downstream of the heat exchanger to absorb heat.

12 Claims, 1 Drawing Sheet

(51) Int. Cl.

| | |
|---|---|
| ***F25B 30/02*** | (2006.01) |
| ***F25B 30/06*** | (2006.01) |
| ***F25B 41/00*** | (2021.01) |
| ***F25B 41/40*** | (2021.01) |

(56) References Cited

U.S. PATENT DOCUMENTS

| | | | | |
|---|---|---|---|---|
| 2012/0272948 | A1 | 11/2012 | Kristjansson | 126/304 |
| 2014/0245763 | A1 | 9/2014 | Grommoll | 62/115 |
| 2016/0370017 | A1* | 12/2016 | Lenk | F24D 11/0207 |
| 2017/0370622 | A1* | 12/2017 | Shin | F25B 27/00 |

FOREIGN PATENT DOCUMENTS

| | | | | |
|---|---|---|---|---|
| DE | 3004062 | A1 | 8/1981 | F24J 3/04 |
| DE | 10 2007 050 446 | A1 | 4/2009 | F25B 30/00 |
| DE | 10 2010 049 134 | A1 | 8/2011 | F25B 39/04 |
| DE | 10 2011 086 476 | A1 | 4/2013 | F25B 30/00 |
| DE | 10 2013 214 891 | A1 | 2/2015 | F25B 30/06 |
| EP | 0523684 | A1 | 1/1993 | F26B 23/00 |
| JP | 2010216784 | A | 9/2010 | F25B 30/06 |
| JP | 2013124846 | A | 6/2013 | F22B 3/00 |
| WO | 2016/016297 | A1 | 2/2016 | D21F 5/20 |
| WO | 2017/013461 | A1 | 1/2017 | F25B 25/00 |
| WO | 2017/072322 | | 5/2017 | F25B 25/00 |

OTHER PUBLICATIONS

Search Report for International Application No. PCT/EP2018/061002, 10 pages, dated Aug. 7, 2018.

Chinese Office Action, Application No. 201880031027.3, 6 pages, dated Nov. 20, 2020.

* cited by examiner

DEVICE AND METHOD FOR INCREASING THE THERMAL OUTPUT OF A HEAT SOURCE

CROSS-REFERENCE TO RELATED APPLICATIONS

This application is a U.S. National Stage Application of International Application No. PCT/EP2018/061002 filed Apr. 30, 2018, which designates the United States of America, and claims priority to DE Application No. 10 2017 208 078.7 filed May 12, 2017, the contents of which are hereby incorporated by reference in their entirety.

TECHNICAL FIELD

The present disclosure relates to heat management. Various embodiments may include district heating networks, heat pumps, and/or related devices and methods.

BACKGROUND

In some applications, waste heat from industrial processes or heat from geothermal sources is used to provide heat for a heat consumer. During this process, heat is typically transferred to the heat sink by means of a heat exchanger or an additional heat pump. If the heat supplied by a heat source is transferred to the heat sink by means of a heat exchanger, the heat sink typically has a heat sink return and a heat sink feed for a fluid in relation to said heat exchanger. During this process, the heat sink return has a lower temperature than the heat sink feed. In other words, at least some of the heat is consumed by the heat sink.

Similarly, the heat source typically has a heat source return and a heat source feed in relation to the heat exchanger. In this case, the temperature of the heat source feed is higher than the temperature of the heat source return owing to the transfer of heat by means of the heat exchanger. Owing to the thermal coupling of the heat source to the heat sink by means of the heat exchanger, the temperature of the heat source return is restricted by the temperature of the heat sink return. In other words, the temperature of the heat source return cannot be reduced further if the heat is to be transferred to the heat sink.

Moreover, the temperature of the heat sink feed is restricted by the temperature of the heat source feed. The restrictions cited result in the disadvantage that the heat source cannot be utilized fully in respect of its heat content. In other words, the heat yield of the heat source is restricted thereby.

SUMMARY

The teachings of the present disclosure may provide systems and/or methods for improving the heat yield of a heat source. For example, some embodiments include a device (1) for increasing the heat yield of a heat source (6), said device comprising: a heat sink (2), a heat pump (4) with a condenser (41) and an evaporator (42), and the heat source (6). The heat sink (2) has a heat sink feed (21) and a heat sink return (22) in respect of thermal coupling to the heat source (6) by means of a heat exchanger (12); and the heat source (6) has a heat source feed (61) and a heat source return (62) in respect of thermal coupling to the heat sink (2) by means of the heat exchanger (12); wherein the condenser (41) of the heat pump (4) is thermally coupled to the heat sink feed (21) in order to dissipate heat to the heat sink (2); characterized in that the evaporator (41) of the heat pump (4) is thermally coupled to the heat source return (62) downstream of the heat exchanger (12) in order to absorb heat.

In some embodiments, the heat sink (2) is part of a district heating network.

In some embodiments, the heat source (6) is a geothermal source and/or an industrial waste heat source.

In some embodiments, the heat pump (4) is designed as a high temperature heat pump.

In some embodiments, the heat pump (4) comprises a working fluid containing R1233zd, R1336mzz, butane, cyclopentane and/or containing a fluoroketone and/or a mixture of said substances.

In some embodiments, the heat pump has an electric power of at least one megawatt.

As another example, some embodiments include a method for increasing the heat yield of a heat source (6) by means of a device (1) as claimed in any one of the preceding claims, said method comprising the following steps: heat transfer from the heat source (6) to the heat sink return (22) by means of the heat exchanger (12); and heat transfer from the condenser (41) of the heat pump to the heat sink feed (21); characterized by heat transfer from the heat source return (62) to the evaporator (42) of the heat pump (4).

BRIEF DESCRIPTION OF THE DRAWINGS

Further advantages, features and details of the teachings herein will become apparent from the illustrative embodiments described below and from the drawings. In the drawings, which are schematic.

Figure 1:
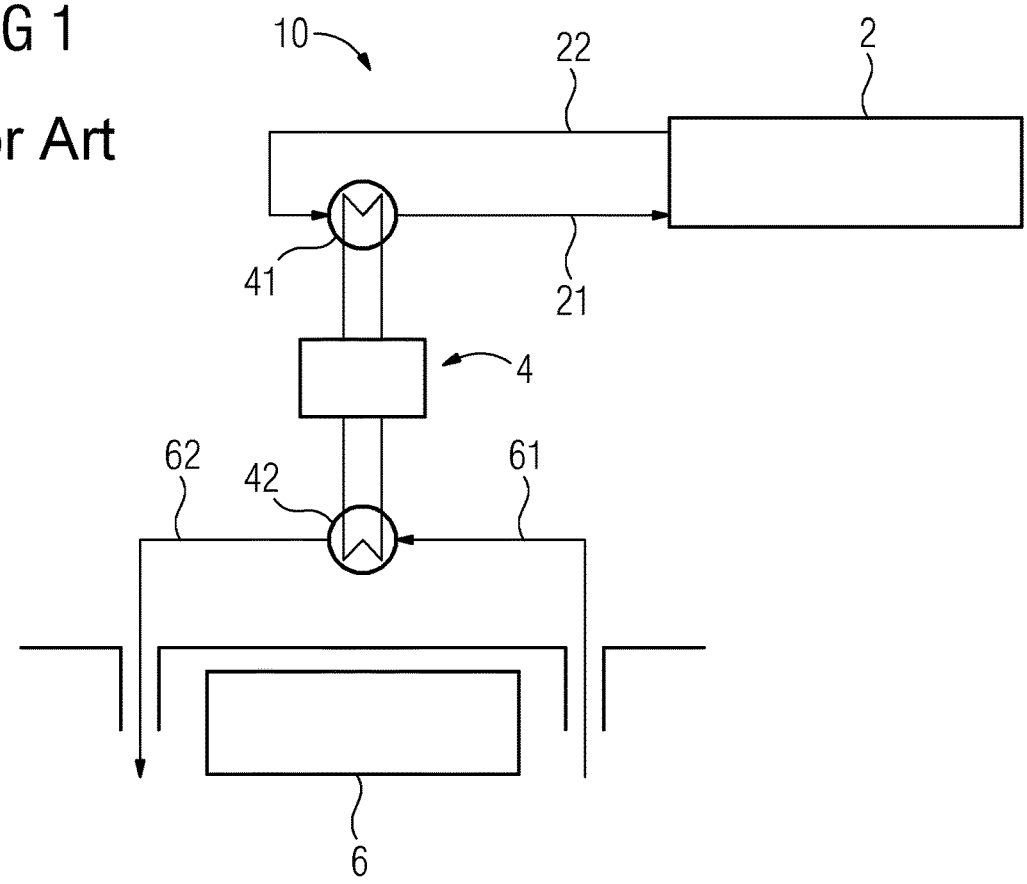
FIG 1 Prior Art
FIG. 1 shows exploitation of a heat source by means of a heat pump according to the prior art.

Elements which are similar, equivalent or have the same effect may be provided with the same reference signs in the figures.

DETAILED DESCRIPTION

Various embodiments include a device for increasing the heat yield of a heat source comprising:

- one heat sink, a heat pump with a condenser and an evaporator, and the heat source; wherein
- the heat sink has a heat sink feed and a heat sink return in respect of thermal coupling to the heat source by means of a heat exchanger; and
- the heat source has a heat source feed and a heat source return in respect of thermal coupling to the heat sink by means of the heat exchanger; wherein
- the condenser of the heat pump is thermally coupled to the heat sink feed in order to dissipate heat to the heat sink.

In some embodiments, the evaporator of the heat pump is thermally coupled to the heat source return downstream of the heat exchanger, in particular directly downstream of the heat exchanger, in order to absorb heat. The heat sink feed and the heat sink return typically form a heat sink circuit for a fluid, wherein the fluid of the heat sink return is heated at least by means of the heat exchanger. After it has been heated by the heat exchanger, the heat sink return becomes the heat sink feed. Thus, the heat sink feed has a higher temperature than the temperature of the heat sink return.

In some embodiments, the heat source feed and the heat source return can form a heat source circuit for a fluid, wherein the fluid of the heat source feed is cooled at least by means of the heat exchanger and the heat thereof is transferred at least partially to the heat sink return to form the heat sink feed. After the cooling of the heat source feed by the heat exchanger, the heat source feed becomes the heat source return. In some embodiments, the heat source return can be partially or fully discharged and thus not returned in whole or in part to the heat source.

Relative arrangements, e.g. the arrangement of an element directly upstream or directly downstream of a further element of the device, concern a direction of a circuit and/or a direction of flow of a fluid, e.g. a direction of a heat sink circuit. The heat sink circuit is formed by means of the heat sink feed and the heat sink return. In some embodiments, the device is characterized in that the evaporator, which is thermally coupled to the heat source return, allows a reduction of the temperature of the heat source return. As a result, the heat source is cooled further, and therefore the heat yield may be increased.

In some embodiments, the heat removed from the heat source return by means of the evaporator is transferred to the heat sink feed by means of the condenser of the heat pump. It is thereby possible to improve the use of the heat source in respect of its heat content and thus to provide more heat or an increased thermal output or an increased temperature for the heat sink. In other words, the incorporation of the heat pump into the heat source or the heat source circuit incorporating teachings of the present disclosure cools the heat source return further and heats the heat sink feed further.

In the case of an industrial waste heat source (heat source), the heat source return according to the prior art must be cooled by means of cooling devices, in particular cooling towers, before it can be discharged, e.g. as a wastewater flow. By means of the further cooling of the heat source return incorporating the teachings herein, the heat source return is consequently cooled to a greater extent, and therefore complex and expensive cooling devices for cooling the heat source return may be eliminated. In addition, the temperature of the heat sink feed may be increased by means of the condenser of the heat pump. As a result, the use of the waste heat source may be improved in respect of its heat content.

In the case of a geothermal source (geothermal heat source), the heat source return thereof is cooled to a greater extent, and therefore the heat yield thereof may be improved. For a geothermal source, there is furthermore an exploration risk. This risk involves the fact that the temperature and the potential mass flow of the thermal water from the borehole cannot be predicted with sufficient certainty. The methods and system taught herein can significantly reduce the cited risk or avoid the need to enter into expensive insurance contracts.

In some embodiments, a method for increasing the heat yield of a heat source by means of a device according to the present invention or one of the embodiments thereof comprises:

- heat transfer from the heat source to the heat sink return by means of the heat exchanger; and
- heat transfer from the condenser of the heat pump to the heat sink feed;

characterized by heat transfer from the heat source return to the evaporator of the heat pump.

The features and/or benefits of the methods taught herein are similar or equivalent to those of the devices incorporating the teachings herein.

In some embodiments, the heat sink is part of a district heating network. It is thereby advantageously possible to increase the thermal output of the district heating network.

In some embodiments, the heat source is a geothermal source (geothermal heat source) and/or an industrial waste heat source. It is thereby possible to further reduce the temperature of the heat source return of the geothermal source, ensuring that the geothermal source can be cooled to an improved extent and thus exploited to an improved extent. Complex and expensive cooling devices for cooling the heat source return may be eliminated for the industrial waste heat source.

In some embodiments, the heat pump comprises a high temperature heat pump. The term high temperature heat pump is used to denote a heat pump which enables heat to be provided at the condenser thereof above 90 degrees Celsius, in particular above 100 degrees Celsius. It is thereby possible to further increase the temperature of the heat sink feed. In particular, the temperature of the heat sink feed can be increased to above 90 degrees Celsius. In other words, the heat source may be uprated in respect of the temperature thereof. To achieve the high temperatures mentioned, the heat pump may comprise a working fluid containing R1233zd, R1336mzz, butane, cyclopentane and/or containing a fluoroketone and/or a mixture of said substances.

In some embodiments, the heat pump has an electric power of at least 1 megawatt. A heat pump adequately dimensioned for industrial applications is thereby provided. The electric power may be appropriate for a district heating network or for recirculation of the heat made available into an industrial process.

FIG. 1 illustrates the exploitation of the heat source designed as a geothermal source 6 by means of a heat pump 4 according to the prior art. The geothermal source 6 is exploited by means of a device 10 which comprises a heat sink 2.

The heat pump 4 comprises at least one condenser 41 and an evaporator 42. In relation to the evaporator 42, the geothermal source 6 has a heat source feed 61 and a heat source return 62. In this case, the temperature of the heat source return 62 is reduced relative to the temperature of the heat source feed 61 owing to the thermal coupling to the evaporator 42 of the heat pump 4. In other words, heat is transferred from the geothermal source 6 to the evaporator 42 of the heat pump 4. The heat is transferred to the heat pump 4 by the at least partial evaporation of the working fluid within the evaporator 42.

In respect of thermal coupling to the condenser 41 of the heat pump 4, the heat sink 2 has a heat sink feed 21 and a heat sink return 22. In this case, the temperature of the heat sink return 22 is reduced relative to the temperature of the heat sink feed 21 or the temperature of the heat sink feed 21 is increased relative to the temperature of the heat sink return 22. In other words, the temperature of the heat source feed 61 is increased by means of the heat pump 4 and dissipated to the heat sink 2 via the heat sink feed 21 by condensation of the working fluid within the condenser 41.

In a typical device 10, the temperature of the heat source return cannot be reduced or cooled further. In other words, the exploitation of the geothermal source 6 is restricted by the heat transfer from the geothermal source 6 to the heat pump 4.

Figure 2:
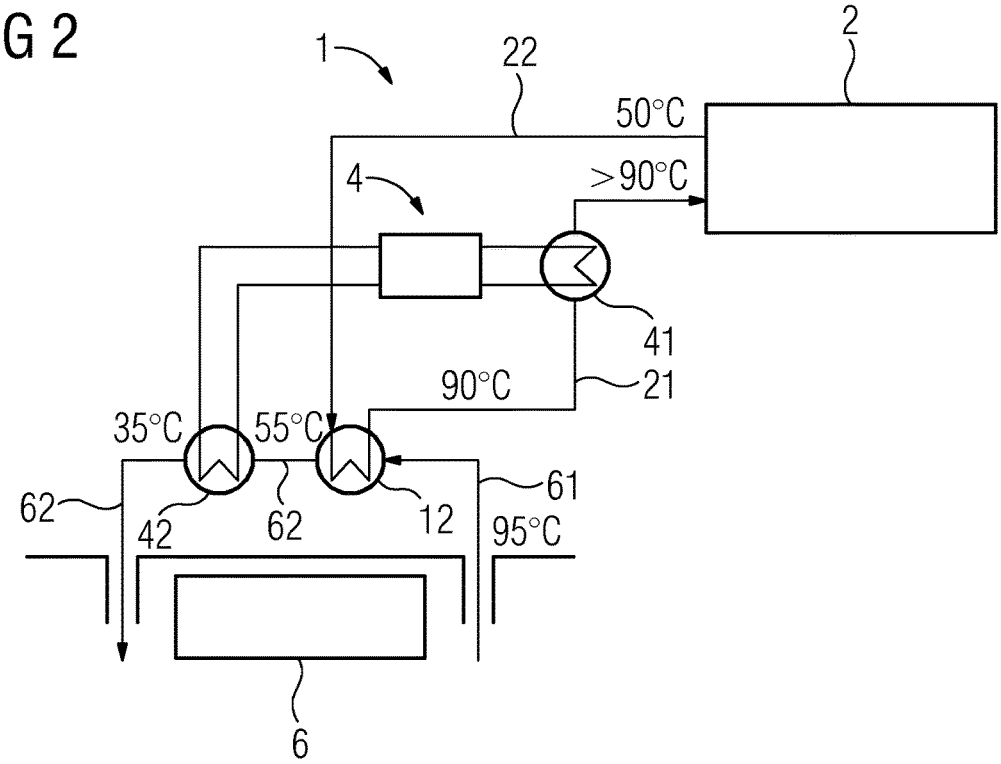
FIG. 2 shows a device incorporating teachings of the present disclosure.

A device 1 according to the first embodiment of the teachings herein is illustrated in FIG. 2. The device 1 comprises a heat pump 4 with a condenser 41 and an evaporator 42. Furthermore, the device 1 comprises a heat source 6, a heat sink 2, in particular a heat consumer, which may be part of a district heating network, and a heat exchanger 12. The heat pump 4 can have a compressor and an expansion valve. A working fluid of the heat pump 4 is at least partially condensed by means of the condenser 41, at least partially compressed by means of the compressor, at least partially evaporated by means of the evaporator 42 and at least partially expanded by means of the expansion valve. R1233zd, R1336mzz, butane, cyclopentane and/or a fluoroketone and/or a mixture of said substances may be used as a working fluid.

In relation to the heat exchanger 12, the heat source 6 has a heat source feed 61 and a heat source return 62. In the illustrative embodiment shown, the temperature of the heat source feed 61 is, by way of example, 95 degrees Celsius. By way of example the temperature of the heat source return 62 between the heat exchanger 12 and the evaporator 42 is 55 degrees Celsius. The temperature of the heat source return 62 after the thermal coupling to the evaporator 42 is approximately 35 degrees Celsius, with the result that the heat source return 62 is cooled further by means of the evaporator 42 or by means of the heat pump 4. In relation to the heat exchanger 12 which couples the heat source 6 thermally to the heat sink 2, the heat sink 2 furthermore has a heat sink feed 21 and a heat sink return 22.

The condenser 41 of the heat pump 4 is thermally coupled to the heat sink feed 21. In other words, said thermal coupling results in at least partial condensation of the working fluid of the heat pump 4, and the heat which is released during this process is transferred to the heat sink feed 21. In this case, said thermal coupling takes place directly downstream of the heat exchanger 12.

The evaporator 42 of the heat pump 4 is thermally coupled to the heat source return 62. In other words, heat is removed from the heat source return 62 by means of the evaporator 42 and transferred to the heat sink feed 21 by means of the heat pump 4 and the condenser 41. The heat source return 62 is thereby advantageously cooled further, thus allowing improved exploitation of the heat source 6 by virtue of the thermal coupling by means of the heat exchanger 12.

In some embodiments, the temperature of the heat source feed 61 is approximately 95 degrees Celsius [° C.], for example. Directly downstream of the thermal coupling of the heat source 6 to the heat sink 2 by means of the heat exchanger 12, the heat source return 62 has a temperature of approximately 55 degrees Celsius. Between the heat exchanger 12 and the condenser 41, i.e. directly downstream of the heat exchanger 12 and directly upstream of the condenser 41 of the heat pump 4, the heat sink feed 21 has a temperature of approximately 90 degrees Celsius. Owing to the absorption of heat by means of the heat pump 4, the heat sink feed has a temperature greater than 90 degrees Celsius directly downstream of the thermal coupling to the condenser 41 of the heat pump 4.

The heat sink 2 may comprise a heat consumer and can consume or use at least some of the heat that can be fed to it by means of the heat sink feed 21. As a result, the heat sink return 22 has a lower temperature of approximately 50 degrees Celsius. In some embodiments, the temperature at the evaporator 42 of the heat pump 4 is approximately 55 degrees Celsius. By means of the evaporator 42 of the heat pump 4, further heat is removed from the heat source return 62, with the result that the temperature of the heat source return 62 is approximately 35 degrees Celsius after the thermal coupling to the evaporator 42 of the heat pump 4. The heat source return 62 is recirculated at its temperature of approximately 35 degrees Celsius. As a result, the heat source return 62 absorbs heat again from the heat source 6 and becomes the heat source feed 61 with a temperature of approximately 95 degrees Celsius.

In some embodiments, the yield of the heat source 6 in relation to the heat content thereof is consequently improved. This is the case because the heat source return 62 is cooled further by means of the thermal coupling to the evaporator 42 of the heat pump 4. In some embodiments, the heat source 6 comprises a geothermal source.

Although the teachings herein have been illustrated and described in detail by means of the preferred illustrative embodiments, the scope thereof is not restricted by the examples disclosed, and other variants can be derived therefrom by a person skilled in the art without exceeding the scope of the disclosure.

The invention claimed is:

1. A device for increasing the heat yield of a heat source, the device comprising:

a heat sink;

a heat pump with a condenser and an evaporator; and the heat source;

wherein the heat sink includes a heat sink feed and a heat sink return providing thermal coupling to the heat source with a heat exchanger;

the heat source includes a heat source feed and a heat source return for thermal coupling to the heat sink with the heat exchanger;

the evaporator extracts heat from the heat source return and the condenser transfers the heat to the heat sink feed; and a working fluid flowing from the heat source passes first through the heat exchanger and then through the evaporator of the heat pump.

2. The device as claimed in claim 1, wherein the heat sink is part of a district heating network.

3. The device as claimed in claim 1, wherein the heat source comprises at least one of a geothermal source or an industrial waste heat source.

4. The device as claimed in claim 1, wherein the heat pump comprises a high temperature heat pump.

5. The device as claimed in claim 4, wherein the heat pump uses a working fluid containing R1233zd, R1336mzz, butane, cyclopentane, a fluoroketone, and/or a mixture of said substances.

6. The device as claimed in claim 1, wherein the heat pump has an electric power of at least one megawatt.

7. A method for increasing the heat yield of a heat source, the method comprising:

transferring heat from a heat source to a heat sink return with a heat exchanger; and wherein the heat sink includes a heat sink feed and a heat sink return providing thermal coupling to the heat source with a heat exchanger;

the heat source includes a heat source feed and a heat source return for thermal coupling to the heat sink with the heat exchanger;

extracting heat from the heat source return using an evaporator of a heat pump and transferring the heat from a condenser of the heat pump to the heat sink feed; and a working fluid flowing from the heat source passes first through the heat exchanger and then through the evaporator of the heat pump.

8. The method as claimed in claim 7, wherein the heat sink is part of a district heating network.

9. The method as claimed in claim 7, wherein the heat source comprises at least one of a geothermal source or an industrial waste heat source.

10. The method as claimed in claim 7, wherein the heat pump comprises a high temperature heat pump.

11. The method as claimed in claim 10, wherein the heat pump uses a working fluid containing R1233zd, R1336mzz, butane, cyclopentane, a fluoroketone, and/or a mixture of said substances.

12. The method as claimed in claim 7, wherein the heat pump has an electric power of at least one megawatt.

* * * * *